US005219691A

United States Patent [19]

Fukuda et al.

[11] Patent Number: 5,219,691

[45] Date of Patent: Jun. 15, 1993

[54] ELECTROPHOTOGRAPHIC PHOTORECEPTOR AND PROCESS FOR PRODUCING THE SAME

[75] Inventors: Yuzuru Fukuda; Shigeru Yagi, both of Kanagawa; Ken Ebihara, Shizuoka; Yasunobu Iwata, Tokyo, all of Japan

[73] Assignees: Fuji Xerox Co., Ltd.; Nippon Light Metal Co., Ltd.; Nikkei Techno-Research Co., Ltd., all of Tokyo, Japan

[21] Appl. No.: 586,287

[22] Filed: Sep. 21, 1990

[30] Foreign Application Priority Data

Sep. 25, 1989 [JP] Japan ..... 1-246504

[51] Int. Cl.[5] ..... G03G 5/047; G03G 5/14

[52] U.S. Cl. ..... 430/58; 430/60; 430/65; 430/131

[58] Field of Search ..... 430/58, 60, 65, 131

[56] References Cited

U.S. PATENT DOCUMENTS

| | | | |
|---|---|---|---|
| 4,369,242 | 1/1983 | Armilli et al. | 430/58 |
| 5,041,350 | 8/1991 | Yagi | 430/58 |

FOREIGN PATENT DOCUMENTS

| | | | |
|---|---|---|---|
| 158 | 1/1984 | Japan | 430/60 |
| 311262 | 12/1988 | Japan | 430/65 |
| 1-246504 | 3/1989 | Japan . | |
| 96178 | 4/1990 | Japan | 430/58 |

*Primary Examiner*—Roland Martin

*Attorney, Agent, or Firm*—Finnegan, Henderson, Farabow, Garrett & Dunner

[57] ABSTRACT

An electrophotographic photoreceptor is disclosed, comprising a support having thereon a light reflection preventive layer comprising a porous anodized film and a photosensitive layer in this order, in which a metal is filled in the pores of the porous anodized film. The anodized film prevents appearance of an interference band when the photoreceptor is applied to a laser beam printer.

19 Claims, 1 Drawing Sheet

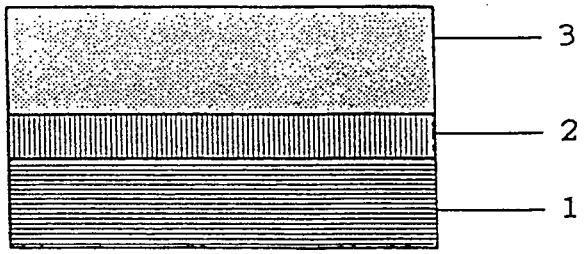
3
2
1

ELECTROPHOTOGRAPHIC PHOTORECEPTOR AND PROCESS FOR PRODUCING THE SAME

FIELD OF THE INVENTION

This invention relates to an electrophotographic photoreceptor and a process for producing the same. More particularly, it relates to an electrophotographic photoreceptor having a light reflection preventive layer and to a process for producing the same.

BACKGROUND OF THE INVENTION

An electrophotographic photoreceptor has recently found its use in apparatus utilizing electrophotographic process using monochromatic light, such as a laser beam printer, and various photoreceptors suitable for that use have been proposed. For example, so-far proposed electrophotographic photoreceptors sensitive to the long wavelength region include those having a photosensitive layer containing a phthalocyanine pigment, e.g., copper phthalocyanine, and particularly those having a photosensitive layer of separate function type which is composed of a charge generating layer and a charge transporting layer; and those having a photosensitive layer comprising a selenium-tellurium alloy. When such a photoreceptor sensitive to the long wavelength region is fixed to a laser beam printer, and light exposure is conducted by scanning with a laser beam, an interference band appears on a developed toner image, and a satisfactory reproduced image cannot be obtained. One of the causes of the interference band is that a long wavelength laser beam is not completely absorbed by a photosensitive layer and the transmitted light is regularly reflected on the surface of a support to cause multiple reflection within the photosensitive layer, which results in interference between the reflected light and the light reflected on the surface of the photosensitive layer.

In order to eliminate this disadvantage, it has been proposed to roughen the surface of a conductive support as described in JP-A-56-107247 or to provide a light absorbing layer or a reflection preventive layer between a photosensitive layer and a support as described in JP-A-57-165844, to prevent multiple reflection within the photosensitive layer. The term "JP-A" herein used means an unexamined and published Japanese patent application.

However, none of the conventionally proposed means actually succeeded to completely prevent development of an interference band on the image. It has therefore been demanded to develop a reflection preventive layer which eliminates the problem of an interference band.

SUMMARY OF THE INVENTION

Accordingly, one object of the present invention is to provide an electrophotographic photoreceptor which provides an image having satisfactory quality while preventing development of an interference band when applied to a laser beam printer.

Another object of the present invention is to provide a process for producing the above-described electrophotographic photoreceptor.

The inventors found that an anodized film formed on a support comprising aluminum or an aluminum alloy has a function of preventing light reflection and thus completed the present invention.

The present invention relates to an electrophotographic photoreceptor comprising a support having thereon a light reflection preventive layer comprising a porous anodized film and a photosensitive layer in this order, in which a metal is filled in the pores of said porous anodized film.

The electrophotographic photoreceptor of the present invention can be produced by a process comprising subjecting a support at least a surface of which comprises aluminum or an aluminum alloy to anodic oxidation in a 1 to 30% by weight acidic aqueous solution containing an inorganic polyproton acid selected from sulfuric acid, phosphoric acid, chromic acid, etc., or an organic polyproton acid selected from oxalic acid, malonic acid, tartaric acid, etc. by applying a direct current of from 0.1 to 10 $A.dm^{-2}$ to form an anodized film on the support, filling a metal in the pores of said porous anodized film by electrodeposition in a solution containing a salt of at least one metal selected from Fe, Ni, Co, Sn, Cu, and Zn and an organic or inorganic ion acting as a complexing agent for said metal(s) to form a light reflection preventive layer comprising the metal-filled porous anodized film, and then forming a photosensitive layer on the light reflection preventive layer.

BRIEF DESCRIPTION OF THE DRAWING

The FIGURE illustrates a schematic cross section of an embodiment of the electrophotographic photoreceptor according to the present invention.

DETAILED DESCRIPTION OF THE INVENTION

The FIGURE is a schematic cross section of the electrophotographic photoreceptor according to the present invention which comprises support 1, e.g., a pipe having a diameter of from 30 to 200 mm, light reflection preventive layer comprising an anodized film 2 formed on support 1, and photosensitive layer 3 formed on light reflection preventive layer 2.

The support which can be used in the present invention includes an aluminum or aluminum alloy support (hereinafter collectively referred to as an aluminum support), other conductive supports, and insulating supports. In using a support other than an aluminum support, it is necessary to form an aluminum film having a thickness of at least 5 μm, preferably 20 μm or more, on the support at least over an area contacting with other layer. The aluminum film can be formed by vacuum evaporation, sputtering, or ion plating. Conductive supports other than an aluminum support include metals, e.g., stainless steel, nickel, chromium, etc., and alloys thereof. Insulating supports include films or sheets of high polymers, e.g., polyester, polyethylene, polycarbonate, polystyrene, polyamide, polyimide, etc., glass, and ceramics.

An aluminum material for obtaining an anodized film having satisfactory characteristics is properly chosen from among pure aluminum and aluminum alloy materials, such as Al-Mg, Al-Mg-Si, Al-Mg-Mn, Al-Mn, Al-Cu-Mg, Al-Cu-Ni, Al-Cu, Al-Si, Al-Cu-Zn, Al-Cu-Si, Al-Cu-Mg-Zn, and Al-Mg-Zn. Preferred aluminum alloys are Al-Mg and Al-Mn.

An anodized film formed on the aluminum surface of the support plays a roll as a light reflection preventive layer.

The anodized film is formed on the support by anodic oxidation as follows. A support with an aluminum surface having been polished to have a mirror finish and cut to a desired size is subjected to degreasing to completely remove oily contaminants attached during mechanical processing. Degreasing can be effected with a commercially available degreasing agent for aluminum.

If desired, the aluminum surface of the support may be roughened. Surface roughening can be carried out by treating with an aqueous solution of sodium hydroxide in a concentration of from 1 to 15% by weight at a temperature of from 35° to 70° C. for a period of from 1 to 30 minutes to obtain a maximum surface roughness $R_{max}$ of from 0.1 to 20 μm, and preferably from 0.5 to 10 μm (measured by a needle contact method according to JIS B0601). If the $R_{max}$ is smaller than 0.1 μm, the produced effect is small. An $R_{max}$ greater than 20 μm leads to unevenness of the resulting image. In a preferred embodiment, surface roughening is carried out in a 3 to 10% by weight sodium hydroxide aqueous solution at 45° to 50° C. for 10 to 20 minutes. In higher sodium hydroxide concentrations or at higher temperatures, roughening proceeds too rapidly, making it difficult to control the maximum surface roughness within a desired range. On the other hand, in lower sodium hydroxide concentrations or at lower temperatures, a long time is required for obtaining a desired surface roughness and, also, local roughening is likely to occur.

After the surface roughening treatment, the aluminum support is sufficiently washed with running water, taking care that the treating solution used in the surface roughening may not be carried over into the next step.

Subsequently, a porous anodized film is formed on the support by anodic oxidation as follows. An electrolytic solution is filled in an electrolytic cell made of stainless steel, hard glass, etc. to a prescribed level. The electrolytic solution which can be used for anodic oxidation is a 1 to 30% by weight, preferably 5 to 25% by weight, acidic aqueous solution of an inorganic polyproton acid selected from sulfuric acid, phosphoric acid, chromic acid, etc. or an organic polyproton acid selected from oxalic acid, malonic acid, tartaric acid, etc. Pure water to be used as a solvent includes distilled water and ion-exchanged water. In order to prevent corrosion of the anodized film or production of pinholes, it is particularly required to remove impurities, e.g., chlorine, from water.

Then, the support having an aluminum surface and a stainless steel or aluminum plate are immersed in the electrolytic solution as an anode and a cathode, respectively, with a given electrode gap therebetween. The electrode gap is appropriately selected from 0.1 to 100 cm. A direct current power source is prepared, and its positive (plus) terminal is connected to the aluminum surface of the support, with the negative (minus) terminal to the cathode plate, and electricity is passed through the both electrodes in the electrolytic solution. Electrolysis is carried out either by a constant current method or by a constant voltage method. The direct current applied may consist solely of a direct current component or may comprise a combination of a direct current and an alternating current. A current density in carrying out anodic oxidation is set between 0.1 $A.dm^{-2}$ and 10 $A.dm^{-2}$. Taking the rate of film formation and cooling efficiency, a current density ranging from 0.5 to 3.0 $A.dm^{-2}$ is preferred. An anodizing voltage usually ranges from 1 to 150 V, preferably 3 to 150 V, and more preferably from 7 to 100 V. The electrolytic solution has a temperature of from −5° to 100° C. and preferably from 0° to 80° C. From the standpoint of production efficiency, production rate, film properties, and the like, the anodic oxidation is most preferably carried out in a 10 to 20% by weight sulfuric acid aqueous solution at a temperature of from 15° to 25° C.

By electrolysis under these conditions, there is formed a porous anodized film on the aluminum surface of the support (anode). The anodized film generally has pores having an average diameter of 2 to 90 nm, preferably 5 to 60 nm and more preferably 10 to 50 nm, and the total opening area of pores at the film surface is generally 10 to 70%, preferably 20 to 50%, more preferably 30 to 50%, based on the entire area of the film surface.

The thickness of the porous anodized film is controlled to fall within a range of from 2 to 30 μm, and preferably from 3 to 10 μm, by varying the time of electrolysis.

The thus formed anodized film is washed with water, and a metal is filled in the pores of the porous anodized film. Filling of a metal is preferably carried out by electrodeposition. The metal to be filled preferably includes Fe, Ni, Co, Sn, Cu, Zn, preferably Ni or Co, and a mixture of two or more thereof.

Where the metal is filled into the pores by electrodeposition, the support having the porous anodized film is dipped in a solution containing a metal salt of at least one metal selected from Fe, Ni, Co, Sn, Cu, and Zn and an inorganic or organic ion acting as a complexing agent for said metal(s). The concentrations of the metal salt and the complexing agent generally range from 0.1 to 500 g/l, preferably from 1 to 200 g/l, respectively. Electrolysis is conducted by using an alternating current having more cathode current components with respect to the sample or an equivalent current.

Metal salts which can be used in the electrolytic solution are not particularly limited as long as they are dissolved into the above-enumerated metal ion. In particular, sulfates, e.g., ammonium ferric sulfate, nickel sulfate, cobalt sulfate, stannous sulfate, copper sulfate, and zinc sulfate, are economically advantageous.

Substances containing an inorganic or organic ion acting as a complexing agent for the metal include those producing an inorganic ion, e.g., boric acid, sulfamic acid, and ammonium sulfate, and those producing an organic ion, e.g., citric acid, tartaric acid, phthalic acid, malonic acid, and malic acid.

Electrodeposition is preferably conducted while controlling the quantity of. electricity so that the metal deposit in the pores may have a height of from 1/10 to 1/1, and preferably from ⅓ to ⅔, the thickness of the porous anodized film. If the height of the metal deposit is less than the above-recited lower limit, the reflectance cannot be sufficiently reduced. Even if it exceeds the thickness of the porous anodized film, further reduction in reflectance cannot be expected, only resulting in waste. The thickness of the metal deposit should be at least 2 μm.

The thus formed metal-filled porous anodized film is washed with water and then with ion-exchanged water or pure water, and rapidly dried in a dry air stream of 80° C. or higher.

On the metal-filled porous anodized film, a photosensitive layer is directly formed in a conventional manner. A photosensitive layer may have a single layer structure or a laminate structure composed of a charge generating layer and a charge transporting layer. The photosensitive layer generally has a thickness of from 10 to 100 μm.

The photosensitive layer includes a layer of an inorganic substance, e.g., amorphous silicon, selenium, selenium hydride, and selenium-tellurium, formed by CVD, vacuum evaporation, sputtering or the like technique. Additionally included in the photosensitive layer is a layer formed by vacuum evaporation of a dyestuff, e.g., phthalocyanine, copper phthalocyanine, Al-phthalocyanine, squaric acid derivatives, and bisazo dyes, or by dip coating of a dispersion of such a dyestuff in a resin. Inter alia, a photosensitive layer formed of amorphous silicon or germanium-doped amorphous silicon exhibits excellent mechanical and electrical characteristics.

The present invention is explained with reference to the formation of a photosensitive layer using amorphous silicon below.

A photosensitive layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by a plasma CVD method is preferred. According to the plasma CVD method, a film containing an adequate amount of hydrogen which has relatively high dark resistance and high photosensitivity and thus exhibits favorable characteristics as a photosensitive layer can be formed.

A plasma CVD method will be illustrated below.

Raw materials for forming an amorphous silicon photosensitive layer mainly comprising silicon include silanes, e.g., monosilane and disilane. In the formation of a charge generating layer, a carrier gas, e.g., hydrogen, helium, argon, and neon, may be used, if desired. These starting gases may be doped with diborane ($B_2H_6$), phosphine ($PH_3$), etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The photosensitive layer which can be preferably used in the present invention mainly comprises silicon and contains from 1 to 40 atom %, and particularly from 5 to 20 atom %, of hydrogen. In this case, the thickness of the photosensitive layer is in the range of from 0.1 to 50 μm, and preferably of from 5 to 30 μm.

Conditions of forming a photosensitive layer are usually from 0 to 5 GHz, preferably from 5 to 3 GHz, in frequency; from $10^{-5}$ to 5 Torr (0.001 to 665 Pa) in degree of vacuum on discharging; and from 100° to 400° C. in substrate heating temperature.

If desired, the electrophotographic photoreceptor of the present invention may have a surface protective layer for preventing denaturation due to corona ion.

The present invention is now illustrated in greater detail with reference to Examples, but it should be understood that the present invention is not deemed to be limited thereto. All the percents are by weight unless otherwise specified.

EXAMPLE 1

An aluminum pipe (diameter: about 120 mm) made of an aluminum alloy containing 4% Mg was dipped in an aqueous solution containing 50 g/l of a degreasing agent ("Fine Cleaner 315" produced by Nihon Parkerizing Co., Ltd.) at 55° C. for 3 minutes, followed by washing with water. The thus treated aluminum pipe had a maximum surface roughness $R_{max}$ of 0.5 μm, and an average surface roughness Ra of 0.015 μm which was the same as the Ra before the pretreatment.

Subsequently, the aluminum pipe was subjected to anodic oxidation in an aqueous solution containing 180 g/l of $H_2SO_4$ and 30 g/l of $Al_2(SO_4)_3.14\text{-}18H_2O$ kept at 20° C. by applying a constant direct current (11 V) at a current density of 2.0 $A.dm^{-2}$ between the aluminum pipe and an aluminum cathode for 10 minutes to form a 7.5 μm thick porous anodized film.

After thoroughly washed with distilled water, the aluminum pipe having a porous anodized film thereon was immersed in an aqueous solution containing 30 g/l of $CoSO_4.7H_2O$, 20 g/l of $H_3BO_3$, and 5 g/l of $(NH_4)_4SO_4$ (pH=4.5), and an alternating current at an effective voltage of 14 V was applied. The time of voltage application was so adjusted that the metal was deposited in the pores to a height of ½ the thickness of the porous anodized film. There was thus formed a light reflection preventive layer comprising the metal-filled porous anodized film.

A photosensitive layer was then formed on the light reflection preventive layer as follows. The aluminum pipe was placed in a vacuum chamber of a capacity-coupled type plasma CVD apparatus. The aluminum pipe being maintained at 200° C., 100% silane gas ($SiH_4$), hydrogen-diluted 100 ppm diborane gas ($B_2H_4$), and 100% hydrogen gas ($H_2$) were introduced therein at a rate of 250 cc/min, 3 cc/min, and 250 cc/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 20 μm-thick photosensitive layer having high dark resistance, comprising so-called i-type amorphous silicon and containing hydrogen and a trace amount of boron.

Positive chargeability of the resulting electrophotographic photoreceptor was measured. When an electric current of 10 μA/cm was passed through the photoreceptor, the initial surface voltage immediately after charging was 760 V, and the dark decay rate was 14%/sec. The residual potential after exposure to white light was 60 V, and the half-decay exposure amount (i.e., exposure amount required for the half-decay of the surface potential) was 11 $erg.cm^{-2}$. The surface reflectance of the photoreceptor at 780 nm was 2%.

Adhesion between the photosensitive layer and the anodized film was proved satisfactory.

For comparison, an electrophotographic photoreceptor was prepared in the same manner as described above, except that the photosensitive layer was directly formed on the porous anodized film without filling the pores of the porous anodized film with a metal. The surface reflectance of the resulting photoreceptor was 10%.

EXAMPLE 2

The same aluminum pipe as used in Example 1 was pretreated in the same manner as in Example 1 and then subjected to anodic oxidation in an aqueous solution containing 150 g/l of $H_3PO_4$ kept at 20° C. by applying a constant direct current (100 V) at a current density of 2.0 $A.dm^{-2}$ between the aluminum pipe and an aluminum cathode for 8 minutes. In order to facilitate metal deposition in the subsequent secondary electrolysis, the aluminum pipe was successively treated in the same electrolytic solution by applying a constant direct voltage of 15 V for 5 minutes. There was formed a 8 μm-thick porous anodized film.

After the aluminum pipe having an anodized film was thoroughly washed with distilled water, secondary electrolysis was conducted in the same manner as in Example 1 to deposit metallic cobalt in the pores to a height of ⅔ the thickness of the porous anodized film.

A photosensitive layer was then formed thereon in the same manner as in Example 1. The resulting electrophotographic photoreceptor was evaluated in the same manner as in Example 1. The results obtained are shown below.

Initial Surface Voltage: 780 V
Dark Decay Rate: 13%/sec
Residual Potential: 55 V
Half Decay Exposure Amount: 10 erg.cm$^{-2}$
Reflectance at 780 nm: 1%

Adhesion between the photosensitive layer and the anodized film was proved satisfactory.

For comparison, an electrophotographic photoreceptor was prepared in the same manner as described above, except that the secondary electrolysis was not conducted.

The resulting photoreceptor was evaluated in the same manner as in Example 1. As a result, the surface reflectance at 780 nm was found to be 9%.

As described above, since the electrophotographic photoreceptor according to the present invention has a metal-filled anodized film as a light reflection preventive layer, on which a photosensitive layer is formed, it provides an image of satisfactory quality while preventing appearance of an interference band when applied to a laser beam printer.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having thereon a light reflection preventive layer comprising an anodized film and over said light reflection preventive layer a photosensitive layer comprising a charge generating layer and a charge transporting layer, wherein a metal is filled in the pores of said porous anodized film, wherein said metal filled in the pores is at least one of Fe, Ni, Co, Sn, Cu, or Zn, and wherein said anodized film has a thickness of from 2 to 30 μm.

2. An electrophotographic photoreceptor as claimed in claim 1, wherein said metal filled in the pores is Ni or Co.

3. An electrophotographic photoreceptor as claimed in claim 1, wherein said anodized film has a thickness of from 3 to 10 μm.

4. An electrophotographic photoreceptor as claimed in claim 1, wherein the height of metal filled in the pores is from 1/10 to 1/1 the thickness of the anodized film.

5. An electrophotographic photoreceptor as claimed in claim 1, wherein the height of metal filled in the pores is from ⅓ to ⅔ the thickness of the anodized film.

6. An electrophotographic photoreceptor as claimed in claim 1, wherein the height of metal filled in the pores is at least 2 μm.

7. An electrophotographic photoreceptor as claimed in claim 1, wherein said photosensitive layer comprises an amorphous silicon.

8. A process for producing an electrophotographic photoreceptor which comprises subjecting a support, at least a surface of which comprises aluminum or an aluminum alloy, to anodic oxidation in a 1 to 30% by weight acidic aqueous solution containing an inorganic polyproton acid wherein said inorganic acid is sulfuric acid, phosphoric acid, or chromic acid, or an organic polyproton acid wherein said organic acid is oxalic acid, malonic acid, or tartaric acid by applying a direct current of from 0.1 to 10 A·dm$^{-2}$ to form a porous anodized film having a thickness of from 2 to 30 μm on the support, filling a metal in the pores of said porous anodized film by electrodeposition in a solution containing a salt of at least one metal wherein said metal is Fe, Ni, Co, Sn, Cu, or Zn and an organic or inorganic ion acting as a complexing agent for said metal(s) to form a light reflection preventive layer comprising a metal-filled porous anodized film, and then forming a photosensitive layer on the light reflection preventive layer, wherein said photosensitive layer comprise a charge generating layer and a charge transporting layer.

9. A process for producing an electrophotographic photoreceptor as claimed in claim 8, wherein said support is subjected to surface roughening to have a maximum surface roughness of from 0.1 to 20 μm.

10. A process for producing an electrophotographic photoreceptor as claimed in claim 8, wherein said anodic oxidation is carried out in a 10 to 20% by weight sulfonic acid aqueous solution.

11. A process for producing an electrophotographic photoreceptor as claimed in claim 8, wherein said direct current has a current density of from 0.5 to 3.0 A.dm$^{-2}$.

12. An electrophotographic photoreceptor as claimed in claim 1, wherein the photosensitive layer has a thickness of 10 to 100 μm.

13. An electrophotographic photoreceptor as claimed in claim 1, wherein the support has a maximum surface roughness Rmax of 0.1 to 20 μm.

14. An electrophotographic photoreceptor as claimed in claim 13, wherein the support has a maximum surface roughness Rmax of 0.5 to 10 μm.

15. An electrophotographic photoreceptor as claimed in claim 1 wherein the photosensitive layer has a laminate structure.

16. An electrophotographic photoreceptor as claimed in claim 8, wherein said prior to anodic oxidation the support is roughened to have a maximum surface roughness of 0.1 to 20 μm.

17. An electrophotographic photoreceptor as claimed in claim 16 wherein the maximum surface roughness is from 0.5 to 10 μm.

18. An electrophotographic photoreceptor as claimed in claim 16, wherein the surface roughening is carried out by treating the support with an aqueous solution of sodium hydroxide in a concentration of 1 to 15% by weight at a temperature of 35° to 75° C. for a period of 1 to 30 minutes.

19. An electrophotographic photoreceptor as claimed in claim 17, wherein the surface roughening is carried out by treating the support with an aqueous solution of sodium hydroxide in a concentration of 3 to 10% by weight at a temperature of 45° to 50° C. for a period of 10 to 20 minutes.

* * * * *

UNITED STATES PATENT AND TRADEMARK OFFICE

CERTIFICATE OF CORRECTION

PATENT NO. : 5,219,691

DATED : June 15, 1993

INVENTOR(S) : Yuzuru Fukuda et al.

It is certified that error appears in the above-indentified patent and that said Letters Patent is hereby corrected as shown below:

Claim 8, column 8, line 23, change "comprise" to --comprises--.

Claim 16, column 8, line 49, before "prior" delete --said--.

Signed and Sealed this

Twenty-sixth Day of April, 1994

Bruce Lehman

*Attest:*

BRUCE LEHMAN

*Attesting Officer*

*Commissioner of Patents and Trademarks*